US006161228A

United States Patent [19]

Wietecha

[11] Patent Number: 6,161,228

[45] Date of Patent: Dec. 19, 2000

[54] PORTABLE SINK APPARATUS AND METHODS OF MANUFACTURE AND USE THEREOF

[75] Inventor: Jan Wietecha, Bothell, Wash.

[73] Assignee: Aseptico, Incorporated, Woodinville, Wash.

[21] Appl. No.: 08/954,932

[22] Filed: Oct. 21, 1997

[51] Int. Cl.[7] ..... A47K 1/00

[52] U.S. Cl. ..... 4/625

[58] Field of Search ..... 4/619, 625–627, 4/630, 638

[56] References Cited

U.S. PATENT DOCUMENTS

| | | | |
|---|---|---|---|
| 1,358,937 | 11/1920 | Curliss | 4/626 |
| 2,594,938 | 4/1952 | Leavitt | 4/638 X |
| 2,989,756 | 6/1961 | Gaston | 4/627 |
| 3,750,196 | 8/1973 | Halferty | 4/625 |
| 4,998,302 | 3/1991 | Silva | 4/516 |
| 5,161,266 | 11/1992 | Hildebrand | 4/603 X |
| 5,301,376 | 4/1994 | Herbert | 4/625 X |
| 5,313,676 | 5/1994 | Wright | 4/638 X |
| 5,335,374 | 8/1994 | Wilk et al. | 4/255.11 |
| 5,526,539 | 6/1996 | Bower et al. | 4/619 X |

FOREIGN PATENT DOCUMENTS

| | | | |
|---|---|---|---|
| 3621151 | 1/1988 | Germany | 4/619 |

*Primary Examiner*—Charles E. Phillips
*Attorney, Agent, or Firm*—James R. Vance

[57] ABSTRACT

Portable sink apparatus attachable to an external, portable reservoir capable of containing a supply of fluid and attachable to an external, portable reservoir capable of containing spent or waste fluid, and methods of manufacture and use thereof.

5 Claims, 9 Drawing Sheets

PORTABLE SINK APPARATUS AND METHODS OF MANUFACTURE AND USE THEREOF

COPYRIGHT NOTICE

@ Copyright 1997 James R. Vance. All rights reserved.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

TECHNICAL FIELD

This invention relates to portable sink apparatus and methods of manufacture and use thereof. More particularly, this invention relates to portable sink apparatus having an external, portable reservoir capable of containing a supply of fluid and an external, portable reservoir capable of containing spent or waste fluid.

BACKGROUND ART

Since Roman times, and possibly before, society has committed large amounts of financial resources, time and labor creating infrastructures that provide a readily available supply of water and means for disposing of waste water. History is filled with construction projects involving the creation of simple and sophisticated: aqueducts; wells; cisterns; large, elevated storage tanks; pools; reflecting pools; dams; locks; reservoirs; desalination plants; ditches; moats; storm sewers; sewage treatment plants; and the like.

Where a readily available supply of water was missing, society's answer to such a problem was to drill a well, build a series of canales or water conduits, and/or construct a desalination plant.

Technology has constantly moved toward creating bigger, grander and permanent water supply and treatment systems.

The cost to create such infrastructures and systems, however, can undermine the financial and labor reserves of a community.

There are also certain situations that do not lend themselves well to the creation of such complex water supply and waste water systems. For example, military forces are frequently required to move quickly to very remote locations and be ready to move again at a moment's notice. Upon arriving at such remote locations, traditional water supply and waste water treatment infrastructures are usually nonexistent.

There may not be sufficient time, machinery or manpower to drill a well. Furthermore, the ground water and/or well water may be inaccessible, contaminated and/or otherwise unusable.

Under such circumstances, usable water must be transported and delivered to military personnel at such remote locations.

The laws of local dictators, monarchs, governments and/or principalities often require that as a condition of using the land as a staging area, drop-off area, or for military maneuvers, the military must not contaminate the land. This includes a prohibition on disposing of waste water on the ground or in local streams, rivers, lakes, seas or oceans. Waste water must be effectively removed from the area or be moved to a designated holding area.

Keep in mind that such military actions often involve tens of thousands of persons. For example, the reader may reflect upon what has become known as the Gulf War, wherein more than 250,000 thousand military personnel were transported to a barren desert location that was devoid of any water supply.

Water that was transported to that desert locale was considered to be a very valuable commodity. To indiscriminately dispose of such water, that could be recycled and reused, was inexcusable. Furthermore, use of such water was usually quite severely rationed.

Given this scenario of a dirty, grimy, possibly contaminated, remote location, now imagine thousands of military personnel exiting heavily used latrines, without facilities to wash their hands, and heading to the mess hall. It is not surprising that many of these individuals became ill and required medical attention. Keep in mind that the nurses, physicians, dentists, and other health professionals that provided medical assistance, used those same or similar latrines.

Heretofore, the only facilities for health professionals to wash their hands in such circumstances was a supply of cold water contained within a water bag that was hung from a tree or post. The neck of the water bag would be uncorked with dirty hands, thereby contaminating the outside of the water bag. The health professional would wash his or her hands, and then the contaminated water bag would be again corked. By re-corking the water bag, the health professional would again contaminate his or her hands.

Although such a method of washing one's hands would be generally considered arcane, inefficient and largely ineffective by anyone's standards, heretofore it was the best system available under such circumstances.

Of course, the risks to all military personnel involved, both to the patients and to the medical personnel, dramatically increased whenever surgery was performed and/or open wounds were treated.

The seriousness of this sanitation problem is exponentially increased when military personnel are operating within a radioactive environment, with radioactive dust settling upon nearly every exposed surface.

The military is not the only group of persons that are faced with this sanitation problem. Other groups, such as campers, boy scout troops, girl scout troops, hunters fishermen, farmers, and field hands that work agricultural crops are similarly faced with this problem.

Similarly, school facilities, medical clinics, and field hospitals in remote locations and within many third world countries also face these same sanitation, water supply, and waste water disposal problems.

The inventor believes that the foregoing information, whether taken alone or in combination, neither anticipates nor renders the present invention obvious. The foregoing explanation does not constitute an admission that such information is relevant or material to the appended patent claims. Rather, such information relates only to the general field of the current disclosure and invention.

DISCLOSURE OF INVENTION

The invention set forth within this disclosure and accompanying claims is easily constructed and is inexpensive and economical to manufacture.

This invention is compact, efficient, reliable, reusable, durable, rugged and washable.

This invention is very extremely simple to use, requiring only a minimal amount of manipulation, physical dexterity, effort and/or knowledge to assemble, use and disassemble.

The apparatus may be easily adjusted or modified to be used within a wide variety of different situations and conditions, thereby accommodating the needs of a larger potential market and consumer base. Adjustment and/or modification of the invention can be accomplished with a minimum amount of delay or difficulty. Depending upon which embodiment of the invention is used, the height of the invention, the temperature of the dispensed fluid, and/or the size of the washbasin or sink may be adjusted.

This invention may be used to dispense cold, cool, warm, or hot fluid or water.

Within one or more embodiments of this invention, the user is permitted to either preset the temperature of the dispensed fluid to a predetermined, set value or, optionally, to quickly and easily adjust such temperature. Consequently, the invention can be easily modified to be used by either enlisted or medical personnel to meet their varying washing or sterilizing needs.

This invention recaptures spent or dispensed fluid, enabling such fluid to be filtered, purified and reused. This permits the user to obtain twice, three-times, four-times or more repetitive usage of such fluid than otherwise possible. In other words, a single container of fluid could be delivered and used for repeated washing events and clean a larger number of personnel than otherwise possible. This feature greatly reduces the need to transport, deliver, store and inventory excessive amounts of fluid to remote locations. The cost savings to the provider of not having to purchase vast numbers of containers, and then to fill, transport, deliver, store, inventory, and replenish such containers is of great economic benefit.

The recapturing feature of this invention also permits the capturing and containment of contaminants, such as radioactive dust particles or biohazard materials that are washed off of the user.

The apparatus of the present invention may assume a general overall appearance of a conventional or traditional sink or washbasin.

Alternatively, this invention may be uniquely configured to conform to the particular needs of a situation. For example, the invention may be configured to removably fit within an alcove or recess within a military tank, or be contoured to be removably secured to an exterior surface of a vehicle.

To minimize cost and increase availability, the inventor prefers to use as many commercially and readily available component parts as possible. Many of the component parts used within this invention are generally readily available throughout the country and in most parts of the world. Consequently, maintenance and repair of this invention may be easily, inexpensively, and quickly accomplished, without experiencing excessive delays or inconvenience. When repair is needed, the user should be able to readily purchase any number of several different commercially available replacement parts and use them with this invention. The particular construction of this invention provides such field repairability.

It is the intention of the inventor that persons using the present invention will experience a significant increase in comfort, sanitation and safety. As a result, it is believed that such persons will be much more productive ii performing their tasks and duties. For example, the present invention not only increases the speed and simplifies the procedure to wash one's hands and soiled objects at a remote location, it also provides means for avoiding the transmission of infections, illness and disease so that the user can concentrate upon other activities without having to constantly worry about becoming contaminated and ill.

To achieve these general and specific objectives, the simplest embodiment of the portable sink apparatus of the current invention generally comprises an apparatus having a cabinet housing, a sink, a fluid reservoir housing, a faucet or spigot, and means for passing the fluid.

The cabinet housing defines an enclosure for the sink, fluid reservoir housing, faucet, and a portion of the means for passing the fluid. The cabinet housing may take a conventional or unconventional form or shape, but should be structurally sound and durable. For example, the cabinet housing may be manufactured from metal, plastic, graphite, or a composite material. The cabinet housing should also be able to be easily cleaned, packed away, and transported.

To place the sink at an appropriate height above the ground or floor, the portable sink apparatus is provided with at least one leg that is attached to or formed integrally with the cabinet housing. Within the preferred embodiment, the apparatus has four such legs. Although, a tripod of three legs or a single pedestal leg could be used. The leg or legs are preferably removably attached or secured to the cabinet housing.

It is also preferable that the leg or legs be capable of being shortened for storage or lengthened for use. For example, each leg may comprise at least two segments that are generally held together with a chain or shock cord to facilitate longitudinal joining thereof. In a manner similar to the assembly of tent poles, the respective lengths of segments of the leg are generally joined end to end to form a single, longer leg. Alternatively, one or more of the legs may be constructed to have a telescoping ability, wherein the legs can be telescopically shortened or lengthened.

The sink may also take a conventional or unconventional form or shape and have a single or variety of different sizes. For example an initial sink with a relatively large fluid holding capacity could be attached to or formed integrally with the cabinet housing. If later desired, one or more sink inserts could be placed within the confines of the initial sink. Each successive sink insert would have a successively smaller fluid holding capacity.

The sink may be manufactured from stainless steel, aluminum, plastic, graphite, or a composite material.

The sink may also be provided with an exposed surface that is at least partially coated, painted, or treated to be at least partially non-reflective. For example, if the sink is manufactured from aluminum or other acceptable material, the sink could be at least partially anodized. Alternatively, the exposed surfaces of the sink could be at least partially coated, painted, or treated to be at least partially camouflaged.

Initially, the fluid used within the portable sink apparatus is stored and transported within an external, portable reservoir. In other words, the supply of fluid is initially provided by the external portable reservoir, to which the portable sink apparatus is removably attached. For example, the portable reservoir may comprise a jerry can, a portable fluid tank, a cistern, or the like.

Within the preferred embodiment of the current invention, two jerry cans are used, namely one to contain a source of pure water or fluid, and the other to contain spent or waste water or fluid.

The portable reservoir is operatively connected to the portable sink apparatus via use of one or more conduits or segments of tubing.

Within the preferred embodiment of the invention, the portable reservoir is also provided with an exposed surface that is at least partially coated, painted, or treated to be at least partially camouflaged and/or enhance a solar heat absorption rate of the fluid contained therein.

Alternatively, the portable reservoir may be provided with a cover that is capable of being placed thereover to either camouflage and/or enhance the solar heat absorption rate of the fluid contained therein.

The fluid reservoir housing is attached to or formed integrally with the cabinet housing. The fluid reservoir housing defines a fluid reservoir enclosure. In essence, once the fluid is pumped or drawn from the portable reservoir, the fluid is temporarily stored within the fluid reservoir enclosure until it is dispensed from the faucet.

The means for passing the fluid from the portable reservoir containing the supply of fluid into the fluid reservoir enclosure and out of the faucet into the sink may comprise a manually or mechanically powered pump or an electrically powered pump. Preferably, the pump is controlled or regulated by activation of a foot-operated mechanism, that may include an on/off switch.

The pump actually serves two purposes or functions. The first purpose or function is to transport the fluid into the sink, without having to impart large hydraulic pressures to the fluid or contained system. The second purpose or function is that the pump serves or functions as a valve.

The portable sink apparatus may also include means for heating the fluid that is contained within the fluid reservoir enclosure. For example, such heating means may comprise an electrically powered heating element that is secured to the fluid reservoir housing and placed within the fluid reservoir enclosure to heat the fluid contained within such enclosure.

Means for regulating the heating means, to generally control a temperature of the fluid contained within the fluid reservoir enclosure, may also be provided. For example, the regulating means may comprise a fluid level control switch that is operatively secured to the cabinet housing or to the fluid reservoir housing to measure a predetermined fluid level within the fluid reservoir enclosure before the heating means is activated or turned on.

Although optical and other electronic sensors could be used, the preferred fluid level control switch is a simple float switch. The heating element cannot be activated when the fluid level is below the level of the float switch. This is a safety mechanism.

By using such a regulating means, the user may be assured that the volume of fluid contained within the fluid reservoir enclosure will be sufficiently large before the heating means is activated, thereby avoiding an unpleasant occurrence of being scalded with overheated fluid.

To accomplish this purpose, at least a portion of the fluid level control switch should be placed within an upper one-half portion of the fluid reservoir enclosure, or higher, depending upon the contained volume of fluid sufficient to activate the fluid level control switch.

Alternatively, or in addition thereto, the regulating means used to control the temperature of the fluid contained within the fluid reservoir enclosure may comprise a thermostat. The thermostat may or may not be adjusted by the operator or user.

When the portable sink apparatus is to be stored or transported, it is desirable to remove all of the fluid previously stored within the fluid reservoir enclosure. Consequently, this invention may also include means for purging the fluid from the fluid reservoir enclosure. For example, the purging means may comprise a mechanically operated valve or evacuation button that is positioned at or near the bottom of the fluid reservoir housing. Once the valve is opened, the fluid contained within the fluid reservoir enclosure is permitted to escape the enclosure via the forces of gravity.

To further facilitate the purging of the fluid reservoir enclosure, the fluid reservoir housing may be provided with an inclined floor that directs the fluid contained within the fluid reservoir enclosure toward the fluid-purging means.

Once a sufficiently large volume of fluid is stored within the fluid reservoir enclosure, such fluid is passed into the sink through the faucet. The faucet is attached or secured to the cabinet housing and/or to the fluid reservoir housing such that a lower portion of the faucet extends into the fluid reservoir enclosure. More importantly, the faucet operatively and movably communicates with the fluid contained within the fluid reservoir enclosure.

Within the preferred embodiment of this invention, a generally extendable and retractable faucet or spigot through which fluid is dispensed into the sink is used. The heating means is not activated until the faucet is raised from a retracted or non-extended position, which is adjacent or nearer to the sink, to an extended or raised position.

When the sink is packed away for transport and shipping, the faucet is pushed downward to its retracted or non-extended position. During use, the faucet may assume either its retracted or non-extended position or be pulled up to its extended or raised position.

The particular construction, structure and interaction between the position of the faucet, placement of the heating means and regulating means within the fluid reservoir enclosure, and level of fluid within such enclosure, all interact to control whether or not cold or heated fluid will pass into the sink. Such construction, structure and interaction will be discussed in detail further below. In essence, however, such construction, structure and interaction is intended to insure that the fluid contained within the fluid reservoir enclosure is sufficiently large before the fluid level control switch is activated.

To further enhance safety of this invention, ground fault circuitry may be provided to protect against electronic leakage and shock.

The portable sink apparatus is also provided with means for passing the fluid from the sink into an external, portable reservoir that is capable of containing spent or waste fluid. In essence, fluid passing into the sink may be expelled therefrom through a drain positioned within the sink's lowermost region. A drain plug capable of selectively preventing or permitting fluid to escape from the sink may also be provided.

Once the spent fluid is expelled through the drain, such spent fluid may be passed via one or more segments of conduit or tubing into another portable fluid reservoir or jerry can for proper disposal. Consequently, the spent or contaminated fluid can be collected directly from the portable sink apparatus or sink and transported in a safe and contained manner to a disposal site.

Alternatively, or in addition thereto, the spent fluid which is expelled through the drain may be passed via one or more segments of conduit or tubing into a waste fluid filtration system that filters the fluid drained from the sink. In this manner, the fluid may be filtered and cleaned for recycling.

This invention is very portable. To further enhance and facilitate the portability of the invention, the portable sink apparatus may be provided with a storage container into which the cabinet housing and/or legs can be inserted. Preferably, the storage container can be hermetically sealed to prevent contamination of the portable sink apparatus during transport and storage.

The current invention also includes a method for providing fluid at a remote location that comprises the following steps:

(a) drawing or pumping fluid from a portable reservoir capable of containing a supply of fluid;

(b) passing the fluid into a fluid reservoir enclosure defined by a fluid reservoir housing attached to or formed integrally with a portable sink cabinet housing; and (c) filling the fluid reservoir enclosure with the fluid such that the fluid is passed through a faucet that operatively and movably communicates with the fluid reservoir enclosure and is attached or secured to the cabinet housing.

The methods of this invention may also include the steps of heating the fluid within the fluid reservoir enclosure when the faucet is raised from a non-extended position which is generally adjacent to a sink to an extended or raised position and the fluid contained within the fluid reservoir enclosure is sufficiently large to activate a fluid level control switch.

In addition to the foregoing advantages and other advantages described further below, the present invention also overcomes all of the previously mentioned disadvantages.

The preferred and several alternative embodiments of the apparatus and associated structures of the present invention, and the processes for manufacture and use thereof, are further described in greater detail in the following description, claims, and drawings of this Specification. However, to avoid any possible confusion as to the scope of the present invention, each of the following sections, claim language, and the drawings of this Specification in their entirety are incorporated herein by this reference.

It should be noted that use of alternative terms throughout this disclosure should be considered as synonyms of one another and not exclusive of cone another. In other words, if one of the many alternative terms is used within the appended patent claims, such term also encompasses all other alternative terms mentioned within this Specification and those covered under the Doctrine Of Equivalents.

The foregoing and other objectives and advantages of the present invention will become more readily apparent upon reading the following disclosure and referring to the attached drawings.

Figure 1:
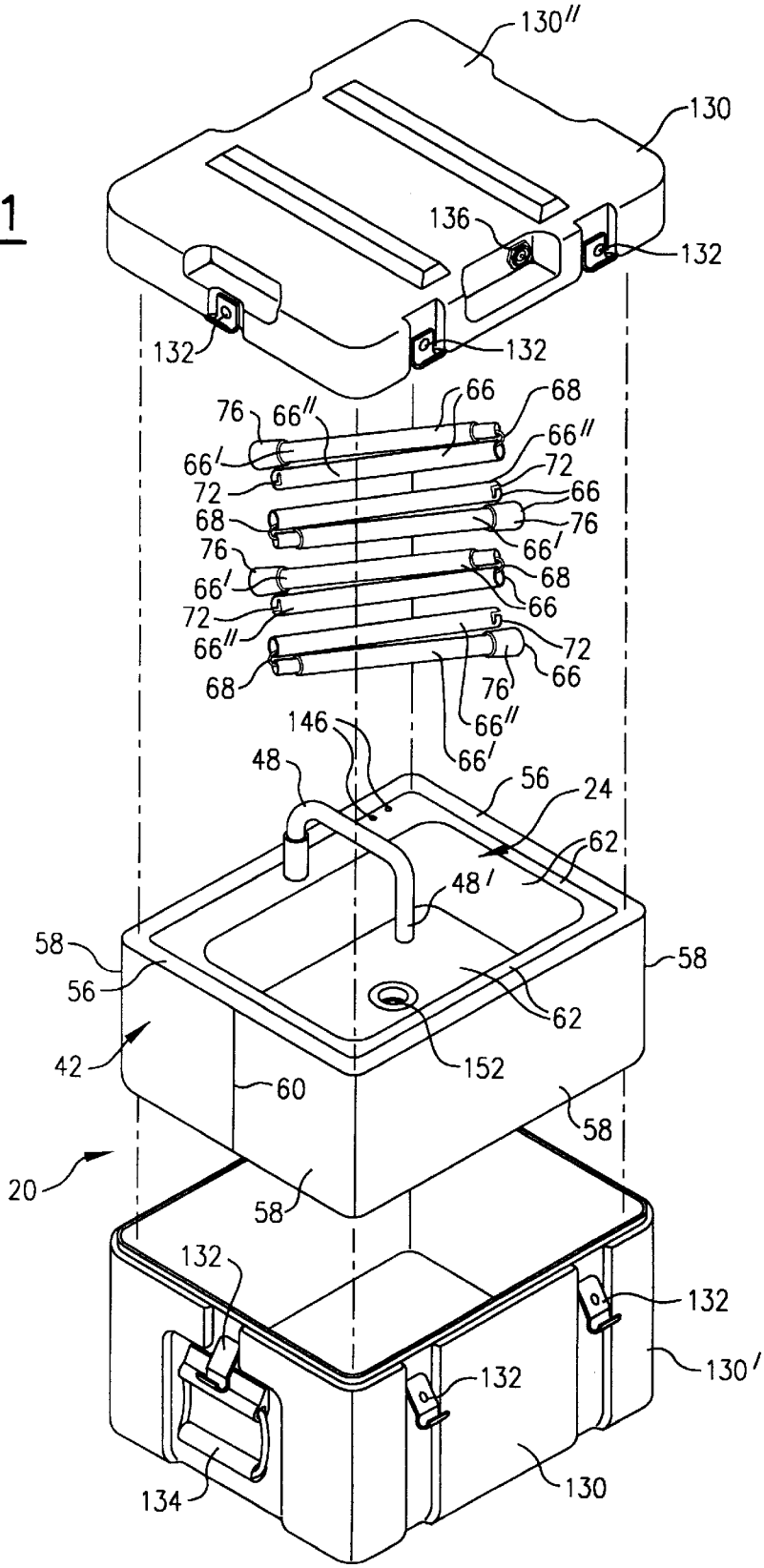
FIG. 1 is an exploded, isometric view of a representative portable sink apparatus made in accordance with the present invention, showing the apparatus in a lowered, partially dismantled and/or collapsed position being either remove from or placed into a storage container.

One should understand that the drawings are not necessarily to scale and the elements are sometimes illustrated by graphic symbols, dotted lined, phantom lines, diagrammatic representations and fragmentary views. In certain instances, the inventor may have omitted details which are not necessary for an understanding of the present invention or which render other details difficult to perceive.

BEST MODE FOR CARRYING OUT THE INVENTION

The attention of the reader is now directed to the attached drawings that illustrate the preferred and several alternative embodiments of the current invention.

Referring to the attached drawings, wherein like numerals indicate like parts, the teachings herein can be used to manufacture a wide variety of differently structured portable sink apparatus 20 for dispensing fluid 22 at a remote location.

Within this disclosure and appended claims, the terms fluid 22 and liquid can be used interchangeably to indicate any aqueous, fluid or semi-fluid substance that settles by gravity to a bottom of a reservoir. For example, this invention may be used to pump water, one or more cleaning solvents, and/or a host of other fluids or liquids into the confines of a sink 24 or washbasin.

It is intended that portable sink apparatus 20 be attached to one or more external sources of fluid 22 or liquid. For example, the external source of fluid 22 may comprise an external, portable reservoir 26 that is capable of containing a supply of the fluid 22.

As shown in FIGS. 2, 9, 10 and 11, the external, portable reservoir 26 may comprise a jerry can 28 that is at least partially filed with the fluid 22. Use of a jerry can 28 to contain the fluid 22 is very convenient. Even when filled to capacity, a traditionally sized jerry can 28 maintains a size and weight that is reasonable for nearly any person to transport, carry and handle. Furthermore, military vehicles are often designed to transport and carry jerry cans 28. Jerry cans 28 are easily obtainable within a military environment, and military personnel are trained in their use. Jerry cans 28 are extremely durable, inexpensive to manufacture or purchase, and are readily available.

Since most jerry cans 28 are manufactured from metal, jerry cans 28 can function as effective heat sinks, enabling the fluid 22 contained therein to quickly absorb solar heat 30 or energy. In this manner, the fluid 22 contained within the jerry cans 28 can be initially preheated prior to being pumped into the portable sink apparatus 20. In other words, the solar heated jerry cans 28 preheat the water of fluid 22 contained therein.

Figure 10:
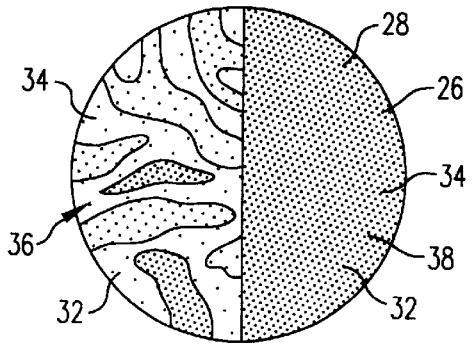
FIG. 10 is a partial, side-elevational view of an exposed surface of an external portable reservoir used with the apparatus of the present invention, wherein the exposed surface is provided with a coating or treatment on at least a portion thereof to provide at least partial camouflage and a coating or treatment on another portion thereof to enhance absorption of solar heat.
Figure 9:
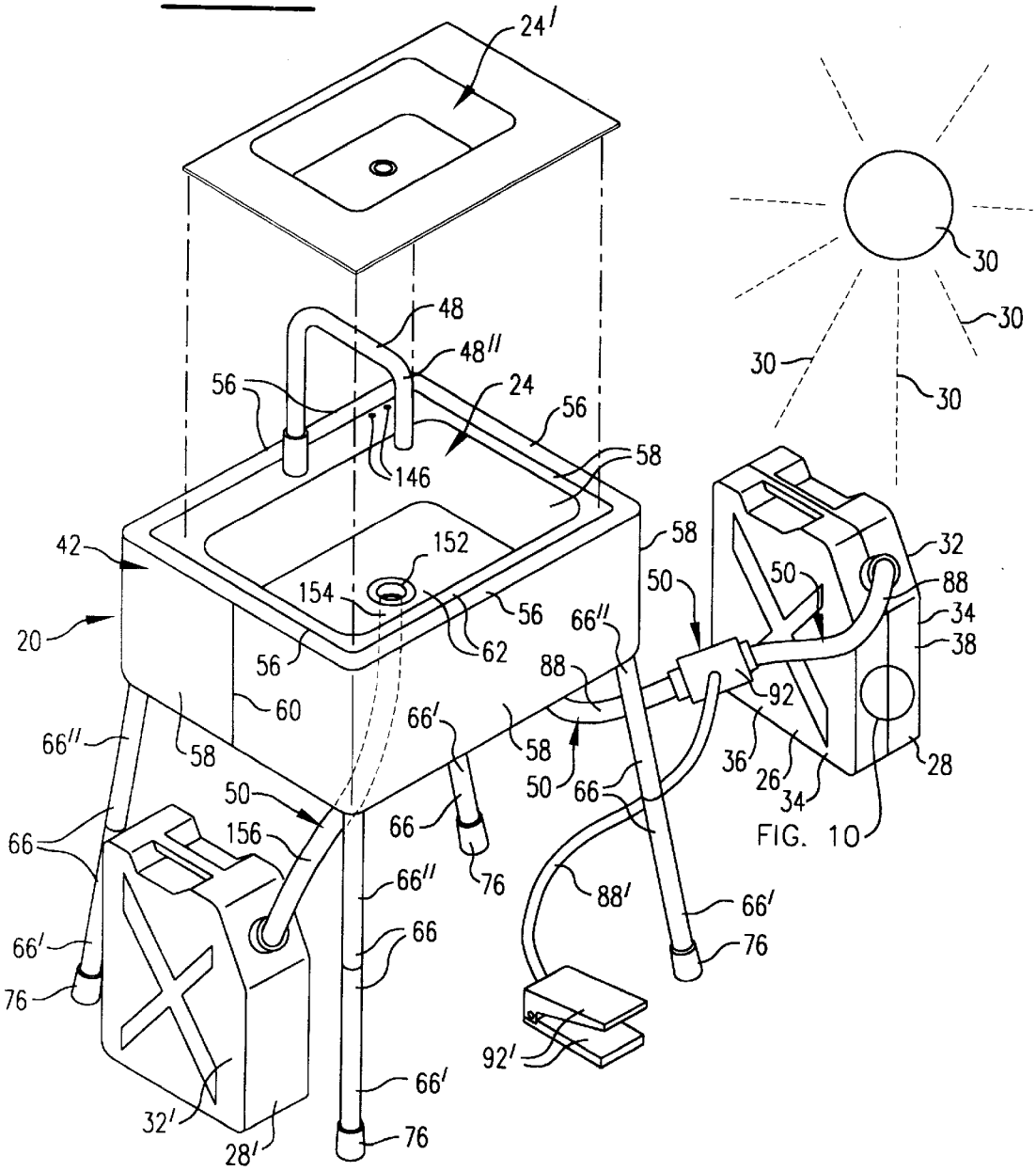
FIG. 9 is a partially exploded, isometric view of the apparatus shown in FIG. 1, showing the apparatus in a raised, assembled and/or deployed position, with legs, an external portable reservoir capable of containing a supply of fluid, an external portable reservoir capable of containing spent or waste fluid, a manually powered, foot-controlled pump, and an optional smaller sink insert attached thereto.

Within an alternative embodiment of the current invention, as shown within FIGS. 9 and 10, the external, portable reservoir 26 or jerry cans 23 may be provided with an exposed, exterior surface 32 that is at least partially coated 34, painted or treated to be at least partially camouflaged 36. This feature enables the apparatus 20 and accompanying components to be transported and used within military environments without drawing the attention of opposing military forces. For example, one side of the jerry can 28 may be painted with a camouflage 36 design.

Figure 11:
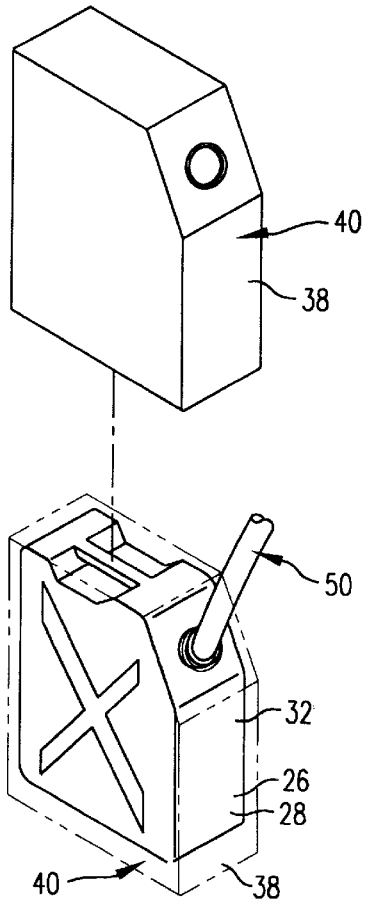
FIG. 11 is an exploded, isometric view of an optional cover for an external portable reservoir that provides at least partial camouflage thereof and/or an enhancement of the absorption of solar heat therein.

Similarly, as shown within FIGS. 9, 10 and 11, the external, portable reservoir 26 or jerry can 28 or cans may be provided with an exposed, exterior surface 32 that is at least partially coated 34, painted or treated to enhance a solar heat absorption rate of the fluid 22 contained therein. For example, one side of the jerry can 28 may be painted with a flat black or flat dark green color or substance 38 to better facilitate solar heat 30 absorption.

Within the preferred embodiment of this invention, one side of the jerry can 28 is camouflaged and the other side is coated 34 with a substance 38 that enhances solar heat 30 absorption.

Within an alternative embodiment of the present invention, as shown in FIG. 11, a rigid, semi-rigid, or flexible cover 40 may be place over the portable reservoir 26. The cover 40 should be capable of enhancing the solar heat 30 absorption rate of the fluid 22 contained within the portable reservoir 26. In other words, a sleeve or hood could be placed overtop and/or about the portable reservoir 26 to accomplish the aforesaid purpose, without requiring the jerry can 28 to be otherwise modified.

Within the preferred embodiment of the invention, the warmed fluid 22 is then gravity fed or pumped into the internal fluid reservoir enclosure 82 to be further selectively warmed and/or heated.

Please keep in mind that the external, portable reservoir 26 need only provide a supply of fluid 22 to the apparatus 20. Although this could be accomplished by using one or more jerry cans 28 that stand alone or are connected in parallel or in series, a larger container of fluid could also be used. For example, the portable reservoir 26 may comprise a truck-carried, helicopter-carried, or tank-carried water tank or portable cistern.

To further accomplish the aforementioned objectives, the apparatus of this invention comprises the combination of: a cabinet housing 42, the sink 24, a fluid reservoir housing 46, a faucet 48, and means 50 for passing the fluid through the apparatus 20.

Figure 7:
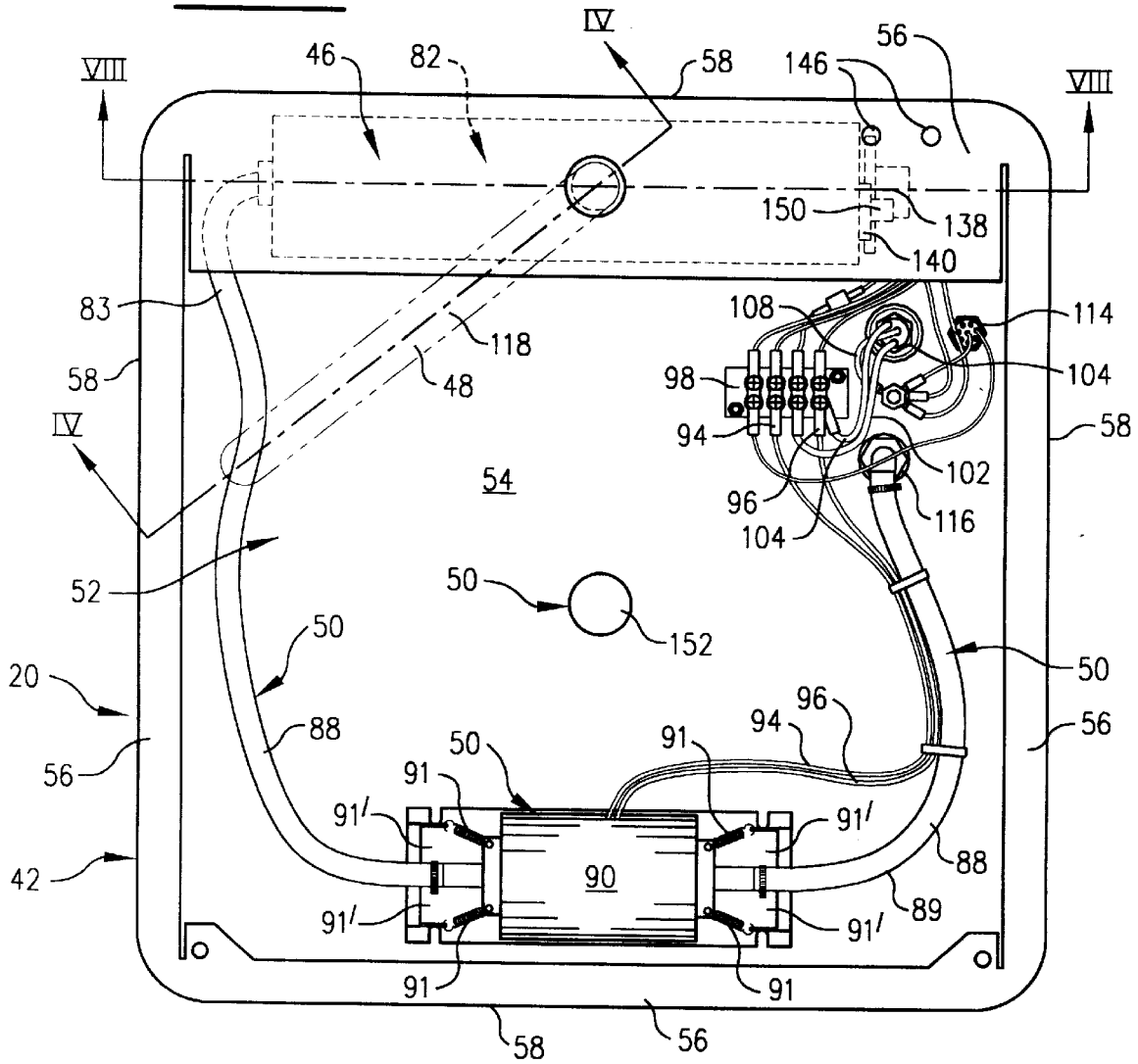
FIG. 7 is an enlarged, partial, plan view of the apparatus of the present invention with the sink removed therefrom, illustrating the elements positioned between the floor of the sink and the bottom or base of the apparatus, including the fluid intake connection or coupling, a mechanically or electrically controlled pump, conduit or tubing between the fluid intake connection or coupling and the pump, an internal fluid reservoir shown in dotted lines, conduit or tubing between the pump and the internal fluid reservoir, the faucet or spigot shown in phantom lines, the drainage or waste fluid exhaust connection or coupling, and optional electrical components or elements used within the apparatus.

More particularly, as best shorn in FIG. 7, the cabinet housing 42 defines an enclosure 52 that generally houses the sink 24, the fluid reservoir housing 46, and most of whatever mechanical and/or electrical components that are ultimately selected for use within a particular embodiment of the apparatus 20.

Within the preferred embodiment of this invention, the cabinet housing 42 generally comprises a four-sided box or container that has a generally closed bottom 54 and a relatively narrow upper counter, rim 56 or flange about the sides 58 thereof to which the sink 24 is attached.

To minimize the amount of welding and/or gluing involved and attendant seams, the sides 58 or sidewalls of the cabinet housing 42 may be constructed from a single sheet of material that is bent to form the four sides 58 thereof. This requires that only one welding and/or gluing seam 60 be used to join the abutted or overlapping terminal ends of the sheet material. This embodiment is shown in FIGS. 1, 5, 9 and 13.

The floor or closed bottom 54 may be attached to the sides 58 sidewalls of the cabinet housing 42 in any desirable manner.

Within the preferred embodiment of the invention, the cabinet housing 42 is manufactured from a very durable metal that will withstand excessive use and abuse.

Figure 2:
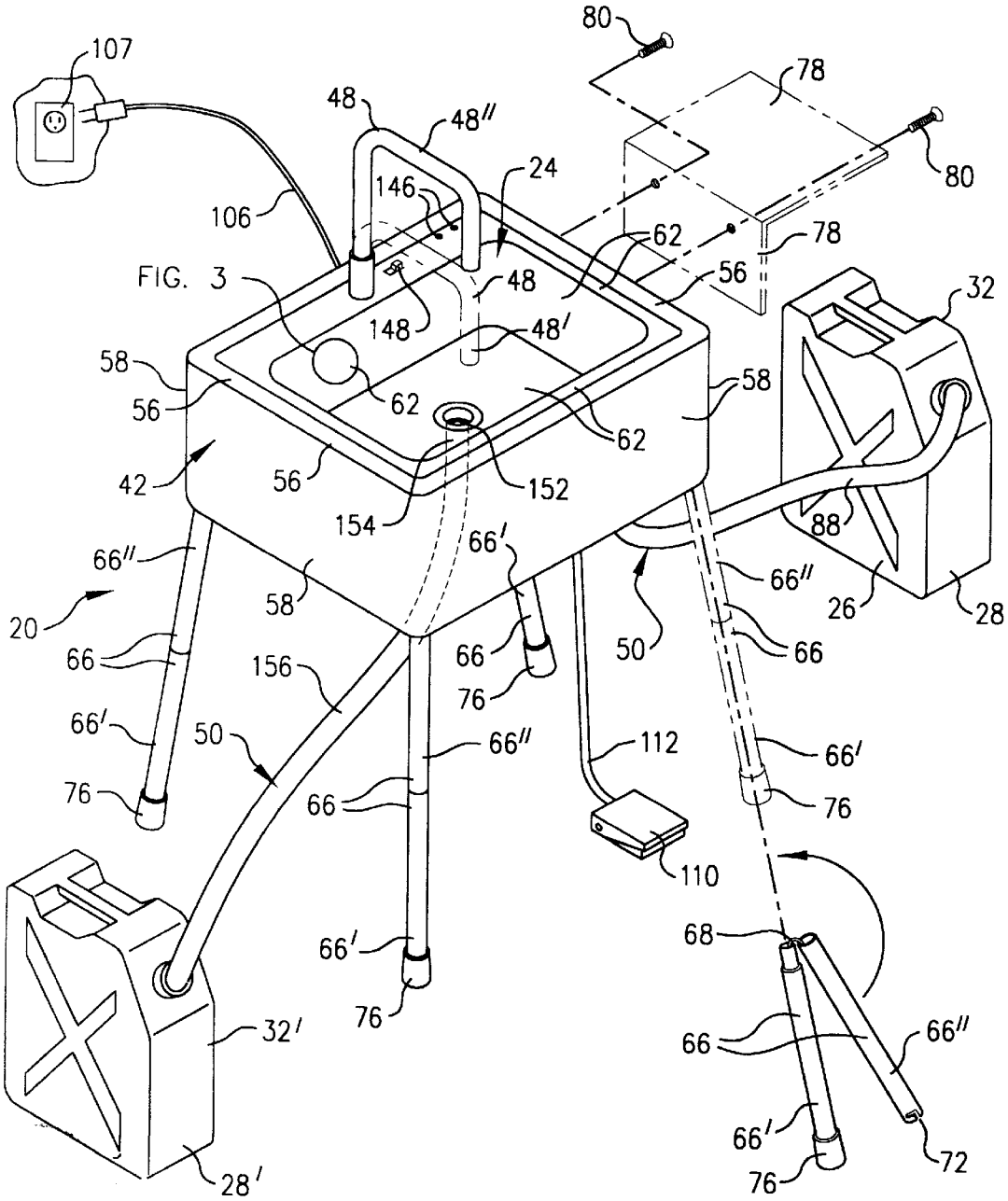
FIG. 2 is a partially exploded, isometric view of the apparatus shown in FIG. 1, showing the apparatus in a raised, assembled and/or deployed position, with legs, an external portable reservoir capable of containing a supply of fluid, an external portable reservoir capable of containing spent or waste fluid, and an electrically powered, foot-controlled switch attached thereto.
Figure 12:
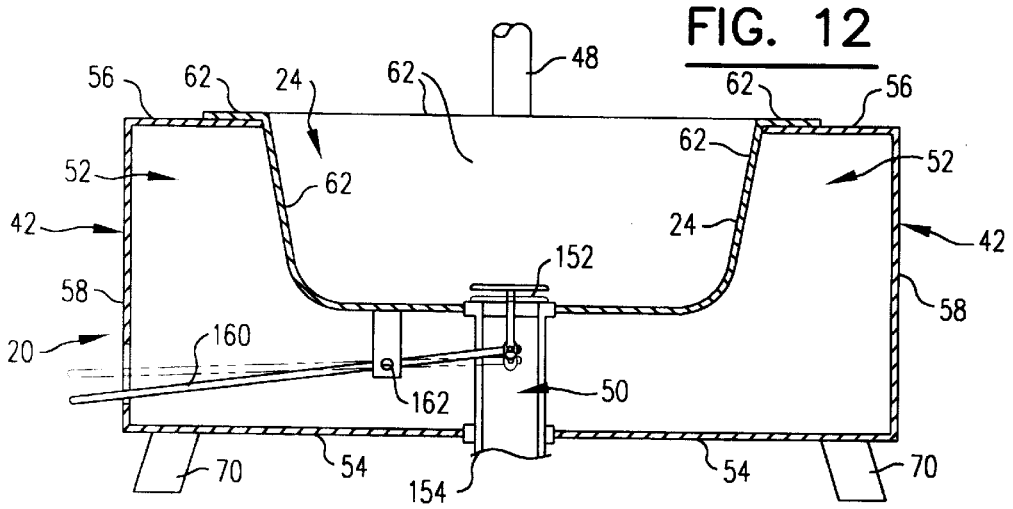
FIG. 12 is a partial, cross-sectional, side-elevational view of the apparatus of the present invention illustrating use of an optional drain plug and lever.

Alternatively the cabinet housing 42 may be manufactured using an injection molding, rotational molding, blow molding, or vacuum-forming manufacturing method. If so constructed, the cabinet housing 42 could be uniform and integral throughout. This embodiment is shown in FIGS. 2 and 12.

It is anticipated that when constructed from plastic, graphite, pelletized metal, or other composite materials, the cabinet housing 42 could be lighter in weight, more easily and inexpensively manufactured, and possibly more durable. The increased durability of the cabinet housing 42 would be most apparent when used in extreme temperature environments, such as when used in sub-zero or extremely elevated temperature conditions, when a metallic cabinet housing 42 would absorb either the excessive heat or cold.

The sink 24 may have a conventional or nonconventional shape, configuration or design. The sink 24 is attached to or formed integrally with the cabinet housing 42.

Within the preferred embodiment of the invention, the sink 24 is manufactured from a stainless steel material.

Alternatively, the sink 24 may be manufactured from aluminum, an aluminum alloy, titanium, or any other metallic, plastic, graphite, or composite material.

Within a further alternative embodiment of the current invention, the sink 24 is formed integrally with the cabinet housing 42 as a single unitary and integral unit.

Figures 3, 4:
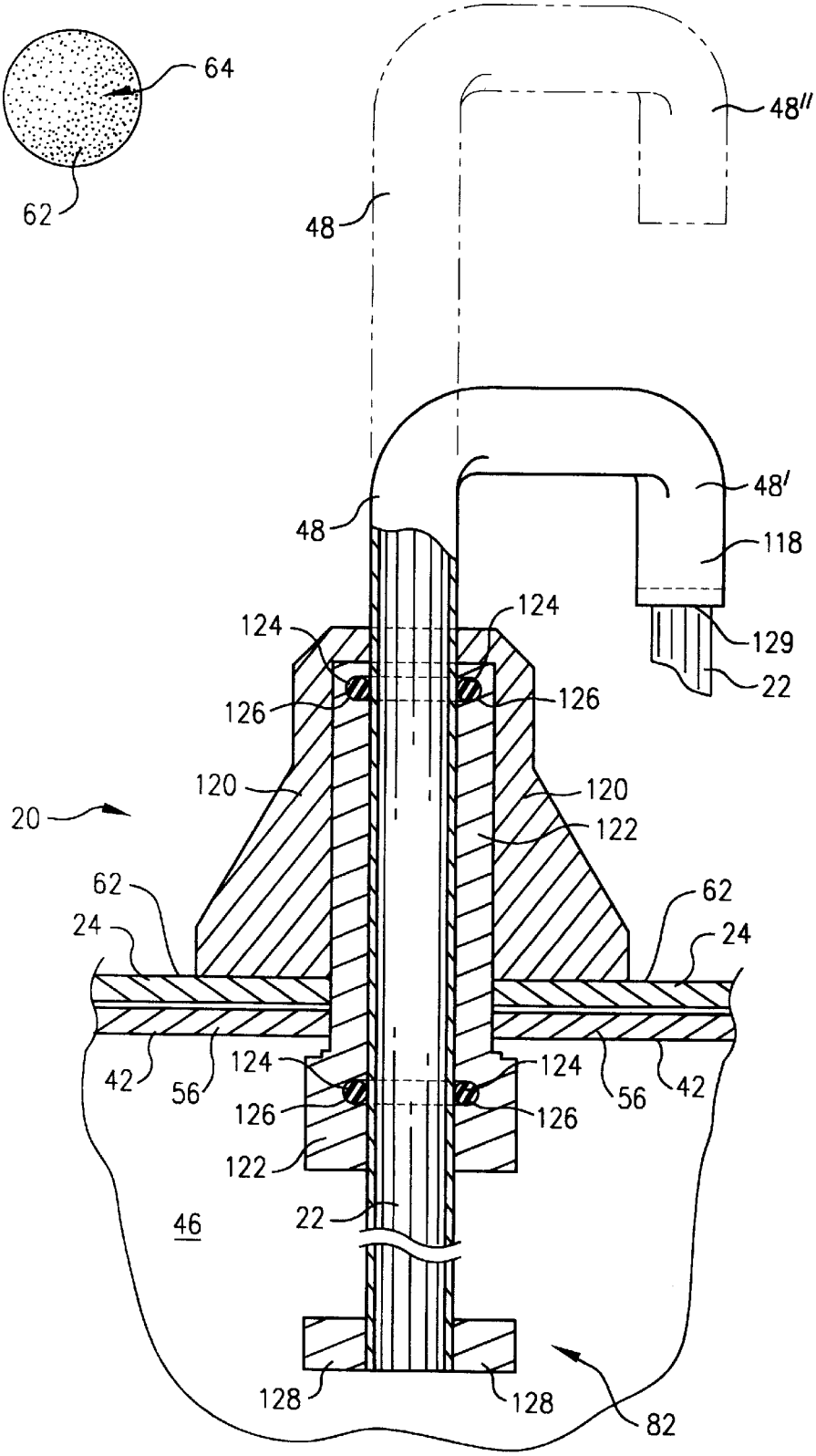
FIG. 3 is a partial, side-elevational view of an exposed surface of a sink used within the apparatus of the present invention, wherein the exposed surface is provided with a coating or treatment to provide at least partial camouflage to the apparatus.
FIG. 4 is an enlarged, partial or fragmentary, cross-sectional view taken along line IV—IV of FIG. 7, illustrating an extendable and retractable faucet or spigot within the apparatus of the present invention through which fluid is dispensed the sink.

As shown in FIGS. 2 and 3, when used by the military, the inventor prefers that at least a portion of the exposed surface 62 of the sink 24 be at least partially coated, painted, or treated to be at least a partially non-reflective substance 64. For example, if manufactured from aluminum, an aluminum alloy, or other compatible material, at least a portion of the exposed surface 62 of the sink 24 may be at least partially anodized.

Alternatively, or in addition thereto, at least a portion of the exposed surface 62 of the sink 24 may be at least partially coated, painted, or treated to be at least partially camouflaged.

It is generally intended that the portable sink apparatus 20 be supported at a height above the ground or floor that is most convenient for the users. To accomplish this objective, the portable sink apparatus 20 may be provided with one or more legs 66 that are attached to or formed integrally with the cabinet housing 42.

For example, within the preferred embodiment of the invention, four legs 66 are provided. Each of the four legs 66 are positioned in a conventional manner at each of the four corners of the base, bottom 54 or floor of the cabinet housing 42, such that they extend downwardly and outwardly therefrom. The angle, cant or outward projection of the legs 66 serves to provide greater stability to the portable sink apparatus 20 when erected and used.

As illustrated within the accompanying drawings, the leg or legs 66 may be selectively removable from the cabinet housing 42.

Furthermore, the leg or legs 66 may be provided with means for shortening or lengthening the length thereof. This enables the leg or legs 66 to be shortened for storage or for use on inclined or uneven terrain. When desired, however, the leg or legs 66 could be selectively lengthened to achieve or provide the desired height and structural support for the portable sink apparatus 20 during use.

As best shown within FIGS. 1, 2, each leg 66 may comprise a tubular member that has at least two segments 66' and 66" or lengths that are generally held together with a chain or shock cord 68 to facilitate longitudinal joining thereof.

Alternatively, one or more of the legs 66 may comprise telescopically mated segments 66' and 66" or lengths that can be joined and selectively and telescopically shortened or lengthened.

Figure 5:
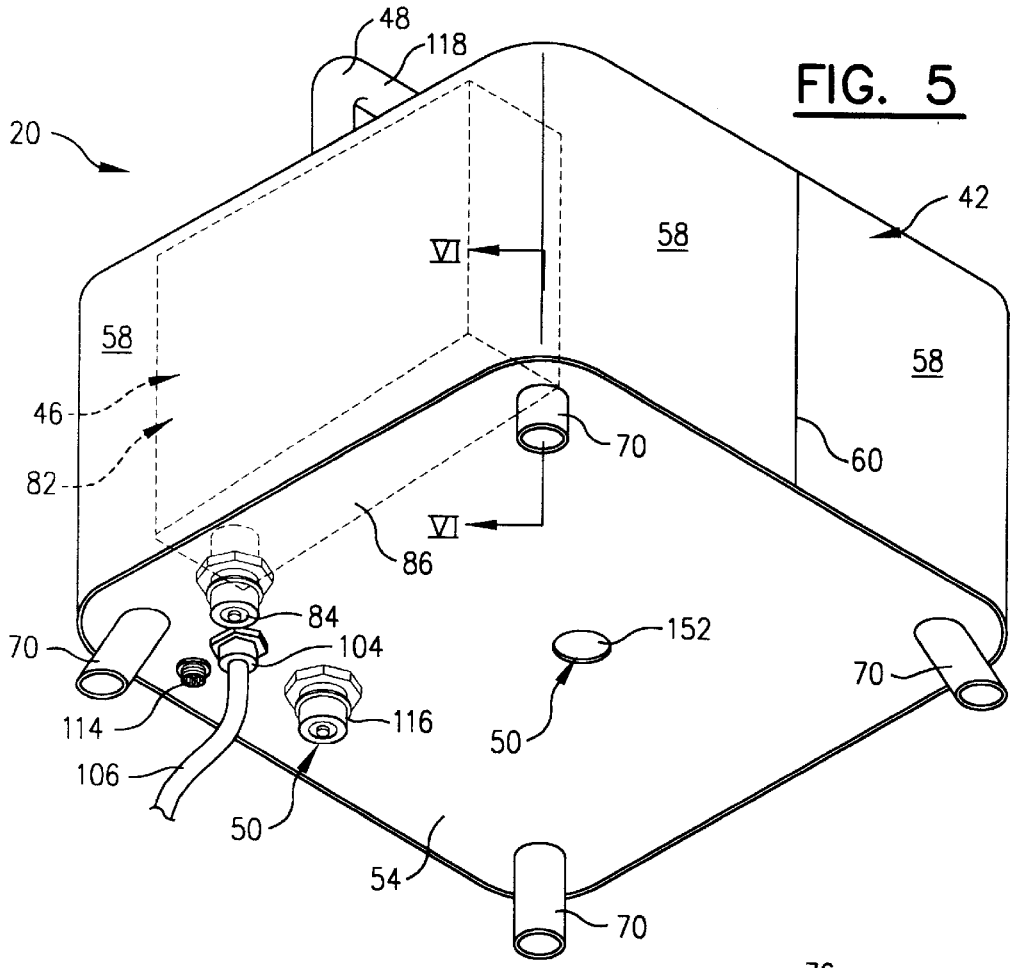
FIG. 5 is a partial, isometric view of a bottom or base of the apparatus and sides of the apparatus shown in FIGS. 1 and 2, further illustrating: leg fittings, connections or couplings; a fluid intake connection or coupling; a drainage or waste fluid exhaust connection or coupling; means for purging fluid from an internal fluid reservoir; an optional electrical coupling, and an optional electrical control coupling.
Figure 6:
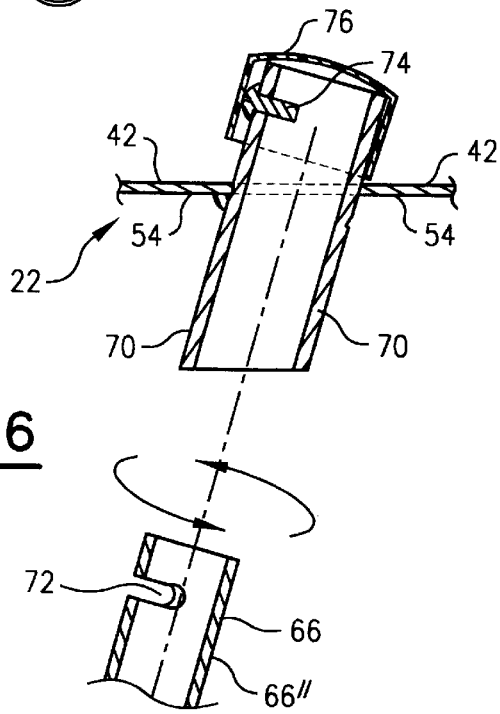
FIG. 6 is an enlarged, partial, exploded, cross-sectional view taken along line VI—VI of FIG. 5, illustrating the preferred means for attaching a leg to the leg connection or coupling.

FIGS. 5, 6 and 12 illustrate the bottom 54 or base of the cabinet housing 42 having several leg connections or couplings 70. This is the preferred means for attaching a leg 66 to the cabinet housing 42. When used, the segment 66" is inserted into the leg coupling 71). Segment 66" is then rotated so that a slot 72 or groove in segment 66" captures and is retained by a peg, bolt 74, screw, or the like that is provided within leg coupling 70, thereby removably securing leg 66 to cabinet housing 42.

Of course, there are several alternative means for securing leg 66 to cabinet housing 42. For example, leg 66 could be simply threaded into or onto a corresponding, mated, threaded leg coupling 70. Furthermore, leg 66 could be held in place within leg coupling 70 by a friction fit, or by a spring biased connector, or the like.

The inventor also prefers to provide each leg 66 and leg coupling 70 with an end cap 76. The end cap 76 provides a cleaner, more finished appearance and prevents dirt, contaminants, and the like, from entering into the hollow interior cavities of such elements.

If desired, a tripod set of legs 66, a single pedestal leg 66, or a greater number of legs 66 may be used.

Alternatively, as shown in FIG. 2, a mounting bracket 78 and associated fasteners 80 could be provided to attach or secure the portable sink apparatus 20 to a wall, fence, post, tree, vehicle, or other structure.

Mounting bracket 78 could also function as a support tray or a drying table or rack.

Focus will now be directed to FIGS. 4, 5, 7, 8A, 8B, 8C and 8D, and, more particularly, to the fluid reservoir housing 46 which is attached to or formed integrally with the cabinet housing 42. In essence, the fluid reservoir housing 46 defines a fluid reservoir enclosure 82.

Within the preferred embodiment of the invention, the fluid reservoir housing 46 is placed within and protected by the cabinet housing enclosure 52.

Alternatively, the fluid reservoir housing 46 could be a separable element that is selectively attached to or secured to the cabinet housing 42.

The fluid reservoir housing 46 generally comprises an enclosed system. As shown in FIG. 7, fluid 22 is passed into the fluid reservoir enclosure 82 through a supply tube 83. The fluid 22 generally exits the fluid reservoir enclosure 82 through the faucet 48, spigot, cock, bibcock or tap.

Since the fluid reservoir housing 46 generally comprises an enclosed system, means 84 for purging the fluid 22 from the internal fluid reservoir enclosure 82 may also be provided. As seen in FIG. 5, the purging means 84 may comprise an escape valve or plug that is placed within the floor 86 of the fluid reservoir housing 46. After the apparatus 20 is used and will be stored for an undetermined period of time, the purging means 84, escape valve, or plug is opened to permit the internal fluid reservoir enclosure 82 to purge itself of all remaining fluid 22 contained therein.

To further enhance the purging of the fluid 22 from the internal fluid reservoir enclosure 82, the fluid reservoir housing 46 may be provided with an inclined floor 86 to urge and direct the fluid 22 contained within the fluid reservoir enclosure 82 via gravity toward the fluid-purging means 84. This feature is best seen within FIGS. 8A, 8B, 8C and 8D.

How the fluid 22 is transported or passed from the external, portable reservoir 26 to the fluid reservoir enclosure 82 and the treatment of the fluid 22 therebetween will be now discussed.

Passing means 50 passes the fluid 22 from the portable reservoir 26 into the fluid reservoir enclosure 82 and out of the faucet 48 into the sink 24.

FIGS. 2 and 9 illustrate passing means 50 as generally comprising a flexible conduit, tube or tubing 88 that passes between the external, portable reservoir 26 and the cabinet housing 42 through which the fluid 22 may pass.

Fluid 22 may pass through tubing 88 via utilization of a gravity feed or through the use of either an electrically or mechanically operated pump 90 or 92, respectively.

To obtain a gravity feed of the fluid 22, the reservoir 26 is simply raised to a level such that the fluid 22 contained therein is at a higher elevation than the top of the faucet 48. For safety reasons and to avoid having to lift and support filled jerry cans 28 at higher than normal elevations, the inventor prefers to use an electrically or mechanically operated pump 90 or 92, respectively.

In other words, passing means 50 may also comprise an electrically powered pump 90 and/or a manually or mechanically powered pump 92. Preferably, the pump 90 and/or 92 is controlled and/or regulated by activation of a foot operated mechanism.

FIGS. 2, 5 and 7 illustrate the use of an electrically operated pump 90. Electrical power is supplied to pump 90 via wires 94 and 96, which are connected to an electrical distribution node 98, which in turn is; operatively connected to wires 100 and 102. Wires 100 and 102 are operatively connected to an optional electrical coupling 104 and power cord 106. Power cord 106 can be plugged into an electric field generator or other adequate electrical supply source 107.

Wire 108 in FIG. 7 is the ground wire.

The electrically powered pump 90 is controlled via an electrically powered, foot-controlled switch 110. Switch 110 is operatively connected to the pump 90 via electrical wires 112 which in turn are attached to the cabinet housing 42 via an optional electrical control coupling 114.

FIG. 7 illustrates the electrically powered pump 90 suspended from springs 91 and a mounting bracket 91' to insulate vibrations of the operating pump 90 from reverberating to, throughout or within the cabinet housing 42.

FIG. 9 illustrates the alternative use of a mechanically or manually operated or powered pump 92. More particularly, a hand and/or foot activated lever 92' can be operatively connected to tubing 88 via tubing 88' and be oscillated up and down or back and forth to cause a suction and/or hydraulic pressure within the tubing 88 and, thereby, urge the fluid 22 toward and into the fluid reservoir enclosure 82.

Within the preferred embodiment of this invention, the portable sink apparatus 20 will be provided with both forms of controls, namely, a foot-controlled switch 110 to be used when apparatus 20 is connected to a source of electricity, and a mechanically or manually operated or powered pump 92 to be used when electrical energy is unavailable.

Referring to FIG. 5, the base 54 of the cabinet housing 42 is provided with a fluid 22 intake connection or coupling 116 to which the tubing 88 from the portable reservoir 26 or jerry can 28 is quickly, removably, and operatively attached. Inside the cabinet enclosure 52, another tubing 89 is operatively connected between the intake coupling 116 and the input side of the pump 90. The supply tube 83 is operatively connected between the output side of the pump 90 and the interior fluid reservoir housing 46. In essence, fluid 22 is successively drawn or pumped from the portable reservoir 26, through tubing 88, through tubing 89, through pump 90 and through supply tube 83 to be deposited within the fluid reservoir enclosure 82.

In summary, the fluid 22 is either gravity fed, or is electrically or mechanically pumped from the portable reservoir 26 into the confines of the fluid reservoir housing 46 and fluid reservoir enclosure 82.

As best shown in FIGS. 2, 4, 8A, 8B, 8C and 8D, the faucet 48 is operatively attached and/or secured to the cabinet housing 42. The faucet 48 also operatively and movably communicates with the fluid reservoir enclosure 82 and a lower portion thereof extends downwardly into the contained fluid 22. FIGS. 2 and 4 illustrate the faucet 48 in a lower position 48' and, alternatively, in a raised upper position 48".

As best seen within FIG. 4, within the preferred embodiment of this invention, the faucet 48 generally comprises a faucet assembly having: a spout or spigot 118; a body, escutcheon, or bonnet 120; an internal mounting cylinder 122; one or more O-rings 124 or washers that are placed within corresponding seats 126; and a stop nut 128 or retaining ring.

The spigot 118 can be raised from a lowered initial position 48' to a raised elevated position 48". The spigot 118 can also serve or function as a handle to lift the apparatus 20 from a shipping container 130, carton or other protective housing.

The bonnet 120 and internal mounting cylinder 122 secure the faucet assembly to the fluid reservoir housing 46 and/or to the cabinet housing 42. The O-rings 124 maintain the generally vertical orientation of spigot 118 and prevent fluid 22 from escaping the fluid reservoir enclosure 82 between the exterior sidewalls of the spigot 118 and the remaining elements of the faucet assembly.

Please note that although a small amount of pressure, above atmospheric pressure, will exist within the fluid reservoir enclosure 82, such pressure will not be excessive. Consequently, the hydraulic forces applied to the O-rings 124 will also not be excessive. In essence, the open end of the spigot 118 serves or functions as a vent to exhaust any excessive buildup of hydraulic pressure and/or overflow.

The O-rings 124 are held in position by their being received and held within seats 126.

The stop nut 128 prevents the spigot 118 from being raised so high as to be pulled from the remaining elements of the faucet assembly. The stop nut 128 may be threaded, soldered, pressure fitted, welded, glued or otherwise secured to the lower portions of the spigot 118. The stop nut 128 is raised and lowered with the spigot 118. When reaching its uppermost stroke, the stop nut 128 is juxtaposed against the lower portions of the internal mounting cylinder 122.

It needed, the spigot 118 could be provided with an aerator 129.

As briefly introduced above, the preferred shipping container 130 for this invention is illustrated within FIG. 1. The durable case or shipping container 130 is easily transported and has a standardized size for products of similar weight. The shipping container 130 has a bottom portion 130' and a clamp on top portion 130" or lid. A plurality of latches 132 are used to secure the top portion 130" to the bottom portion 130' of the shipping container 130. The shipping container 130 may also be provided with one or more handles 134 to assist in carrying the invention.

The shipping container 130 may also have an atmospheric pressure valve 136 therein to prevent the shipping container 130 from exploding or imploding when exposed to dramatic increases or decreases of cabin pressure, such as when transported in an airplane or dropped therefrom.

The shipping container 130 may have recessed portions therein, within which the handles 134 and the atmospheric pressure valve 136 may be placed.

Such shipping containers 130 are readily available and are commonly used within the military establishment.

The reader's attention is now directed to FIGS. 8A, 8B, 8C, and 8D, which schematically illustrate how a heating element 138 and activating switch 140 are engaged during operation of this invention.

Within the preferred embodiment cf this invention, the activating switch 140 is a fluid level control switch, such as a trip lever or float switch having an arm or lever 140' and a float ball 140". Alternatively, an electrically and/or optically triggered switch may be used.

Figure 8A:
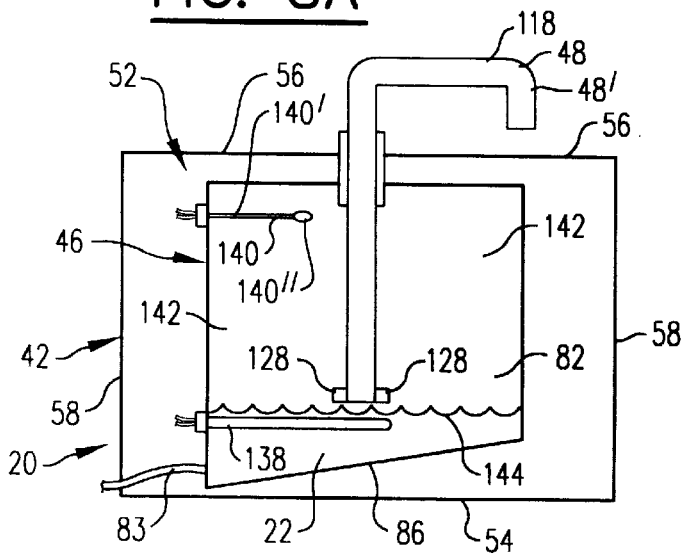
FIGS. 8A, 8B, 8C and 8D are internal, schematic, side-elevational views taken along line VIII—VIII of FIG. 7, illustrating the interaction between a heater element, a fluid level control switch, such as a float switch, and the faucet or spigot as the fluid level within the internal fluid reservoir increases.

As shown in FIG. 8A, during initial use of this invention, fluid 22 is pumped into the fluid reservoir enclosure 82. Please note the low level or small volume of the fluid 22 contained within the fluid reservoir enclosure 82 at this juncture. It is undesirable to activate the heating element 138 at this time, because the amount or volume of fluid 22 that is heated is so small that such fluid 22 may become excessively hot and burn or scald the user.

Figure 8B:
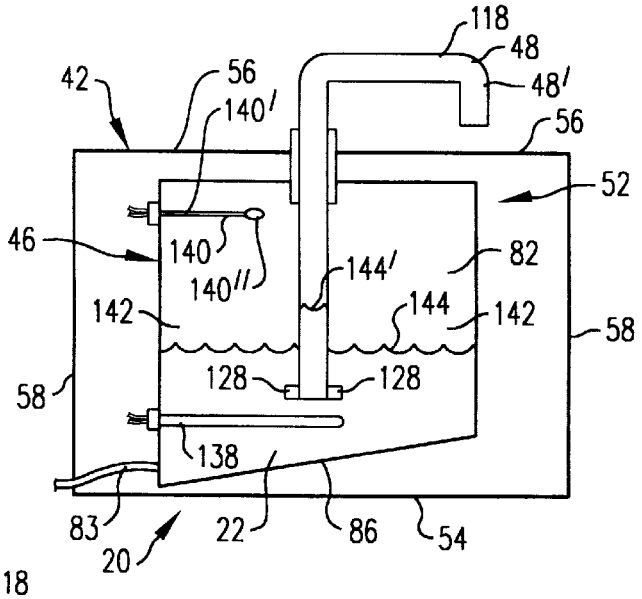

Referring now to FIG. 8B, the pumping of the fluid 22 into the fluid reservoir enclosure 82 continues capturing a certain amount of air 142 above the fluid level 144. This captured air 142 is somewhat compressed as the fluid level 144 rises. Consequently, the fluid level 144' within the spigot 118 is higher than the fluid level 144 within the fluid reservoir enclosure 82. The heating element 138 is still not activated at this time.

Figure 8C:
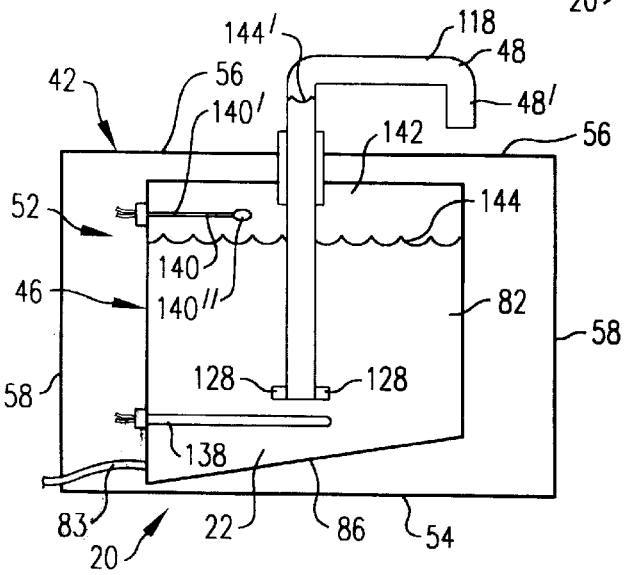

Referring to FIG. 8C, as more fluid 22 is pumped into the fluid reservoir enclosure 82 the fluid level 144 continues to rise. If the spigot 118 remains in its lowered position 48', the fluid level 144' will eventually rise high enough that fluid 22 is expelled or exhausted out of the terminal end of the spigot 118 without the fluid level 144 actually reaching the activating switch 140. Consequently, when the spigot 118 maintains and is not raised from its initial position, the activating switch 140 and heating element 138 are not activated and fluid can escape from the fluid reservoir enclosure 82 without being heated.

At this stage in the procedure, a sufficiently large enough volume of fluid 22 is contained within the fluid reservoir enclosure 82 that if the heating element 138 was activated, the user would not be scalded. However, the only way to activate the heating element 138 within this embodiment of the invention is to vent the compressed air 142 from above the fluid level 144, thereby permitting the fluid level 144 to raise even further and trip or activate the activating switch 140.

Figure 8D:
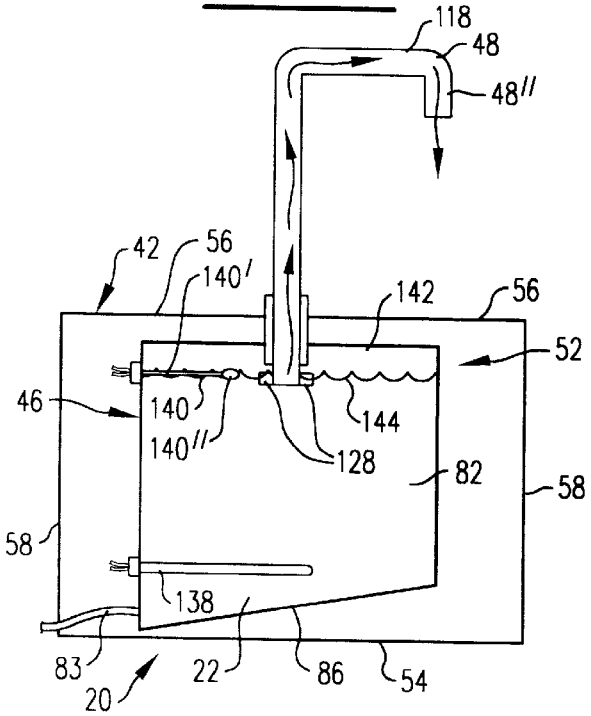

As seen within FIG. 8D, the spigot 118 can be lifted or raised, permitting the compressed air 142 located above the fluid 22 to escape or be vented. With this reduction in pressure, the fluid level 144 raises even further until the activating switch 140 is triggered or activated.

Please note that the internal fluid reservoir enclosure 82 cannot be substantially or completely filled until the faucet 48 or spout is raised. Consequently, the activating switch 140 cannot be triggered or activated until the faucet 48 or spigot 118 is raised.

Once triggered or activated, the activating switch 140 permits electrical current to pass into the heating element 138 to heat the fluid 22 contained within the fluid reservoir enclosure 82.

In other words, the adjustable air pressure contained within the internal fluid reservoir enclosure 82, which is manipulated by movement of the faucet 48, controls the fluid level 144 and activates or disengages the activating switch 140 or float switch to either turn on or off the heating element 138.

This invention is not what most persons would consider to be an artificially pressurized system. We are not dealing with highly elevated atmospheric or hydraulic pressures that would place strain and pressure throughout the system. Rather, the only needed pressure is to transport the fluid 22 through the system from the jerry can 28 to the height of the faucet 48. The pressures involved within this invention are only slightly higher than the ambient air pressure.

Consequently, there is no need to include a separate safety pressure relief valve within this invention. In essence, the faucet 48 functions as the safety pressure relief valve.

In other systems, if the safety pressure relief valve fails the entire system could explode and spray boiling water over the user and those standing close by.

The system of this invention is open by design. There are less necessary components. There are less necessary electronics. However, there is more inherent safety.

Furthermore, the fluid reservoir enclosure 82 and the activating switch 140 or level/float switch that is contained therein are isolated from the external environment and the possibility of being damaged or contaminated.

After the activating switch 140 has turned on the heating element 138, the spigot 118 can be lowered back to its initial position without turning off the heating element 138.

If desired, an in-line flow switch could be placed within the apparatus to turn off the heating element 138 when fluid 22 is no longer pumped into the fluid reservoir enclosure 82. However, as soon as the flow of fluid 22 recommences, the heating element 138 could be reactivated. At this time, however, the fluid reservoir enclosure 82 is nearly full of fluid. Consequently, the heating element 138 would not overheat a small volume of fluid 22, but rather must heat all of the fluid 22 contained within the fluid reservoir enclosure 82.

Alternatively, electrical power to the activating switch 140 could be controlled by the electrically powered, foot-controlled switch 110. In essence, the electric pump 90 and the heating element 138 could be activated simultaneously This system will prevent the heating element 138 from overheating the fluid 22 within the fluid reservoir enclosure 82.

The apparatus 20 may also be provided with selectively illuminated indicator lights 146 and associated electrical hardware to indicate whether or not the pump 90 and/or heating element 138 are activated. The indicator lights 146 are illustrated within FIGS. 1, 2, 7 and 9.

Alternatively, or in addition thereto, apparatus 20 could also be provided with an on/off switch 148 that controls the flow of electrical current to the pump 90 and/or to the heating element 138. The on/off switch 148 is illustrated within FIG. 2.

It should be remembered, however, that within the preferred embodiment of the invention the faucet 48 or spigot 118 functions as a low-water safety shut-off for the heating element 138.

If desired, a thermostat 150 could also be operatively attached or secured to the fluid reservoir housing 46 to control the temperature of the fluid 22 contained within the fluid reservoir enclosure 82 and the associated heating element 138.

The fluid 22 is subsequently dispensed through the faucet 48 or spigot 118 into the sink 24.

The portable sink apparatus 20 may further include means for passing the fluid 22 from the sink 24 into an external, portable reservoir 32' capable of containing spent or waste fluid 22. More particularly, the sink 24 has a drain 152 positioned at the bottom thereof through which spent or waste fluid may be drained or exhausted from the sink 24.

A fluid exhaust connection or coupling 154 is then attached to the drain 152 to further facilitate drainage of the spent or waste fluid 22. A drainage conduit, pipe or tubing 156 may subsequently be removably secured to the exhaust coupling 154. The drainage conduit, pipe or tubing 156 then is connected to the waste fluid reservoir 32', such as to another jerry can 28'.

If it is desired to at least partially fill the sink 24 with fluid 22, a drain plug 158, that is capable of selectively preventing fluid 22 from escaping the sink 245 through the drain 152, can be used. The drain plug 158 may simply be a cork or rubber plug.

Alternatively, as best illustrated within FIG. 12, the drain plug 158 may comprise a mechanically operated plug that is selectively raised or lowered via use of a lever 160 that pivots about a fulcrum 162.

Figure 13:
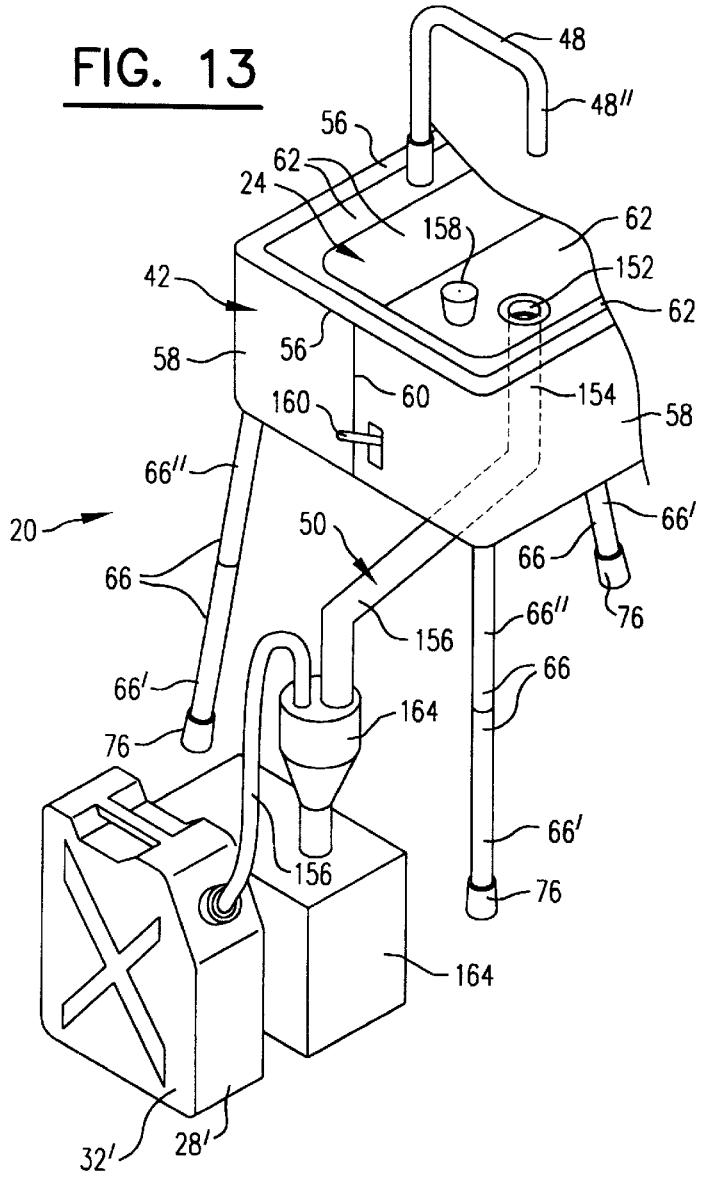
FIG. 13 is a partial, isometric view of the apparatus of the present invention illustrating use of an optional waste fluid filtration system.

FIG. 13 illustrates use of a waste fluid filtration system 164 for filtering waste fluid 22 that is drained from the sink 24. Many different waste fluid filtration systems 164 are currently available in the marketplace and one may be selected that accomplishes the particular needs of the user.

Originally, the portable sink apparatus 20 was designed for the washing of small dental and medical instruments, utensils and the hands of personnel. However, various forms of the sink apparatus 20 could likewise be built to provide a washing location for food products, hand washing adjacent to field latrines, and numerous other applications.

FIG. 9 illustrates use of an additional, optional smaller, sink insert 24' that may be placed within the sink 24. A variety of different sized sink inserts 24' may be provided. The sink insert 24' may be used to reduce the size or volume of the sink cavity or capacity. In other words, the fluid holding capacity will necessarily be different for the sink insert 24' as the sink 24.

Alternatively, the sink insert 24' may be used in radioactive or other hazardous conditions to accomplish the purposes of this invention without requiring the entire apparatus 20 being disposed of at the conclusion of its use.

In brief summary of the foregoing disclosure, the preferred embodiment of the current invention includes:

(a) means for supplying fluid 22 to the apparatus 20;
(b) means for pumping the fluid 22 to the sink 24;
(c) means for collecting the fluid 22 within a fluid reservoir enclosure 82;
(d) means for preventing the heating of the fluid 22 until the internal fluid reservoir enclosure 82 is filled to at least a predetermined level or volume;
(e) means for heating the fluid 22 within the fluid reservoir enclosure 82;
(f) means for regulating the temperature of the fluid 22 contained within the fluid reservoir enclosure 82;
(g) means for purging the fluid reservoir enclosure 82 of fluid 22 when desired;
(h) means for draining fluid 22 from the sink 24;
(i) means for filtering the spent or waste fluid 22 drained from the sink 24; and
(j) means for capturing and retaining the spent or waste fluid 22 for later disposal.

Upon unpacking, with the exception of attaching or snapping the legs 66 into place and securing the hoses or tubing into the appropriate jerry cans 28 and 28', the apparatus 20 of this invention is entirely pre-assembled and ready for immediate use. The total weight of the apparatus 20 is about forty-five pounds (45 lbs).

The means and construction disclosed herein are by way of example and comprise primarily the preferred and several alternative forms of putting the invention into effect.

Although the drawings depict the preferred and several alternative embodiments of the invention, other embodiments are described within the preceding and following text. One skilled in the art will appreciate that the disclosed apparatus and devices may have a wide variety of designs, shapes and configurations. Additionally, persons skilled in the art to which the invention pertains might consider the foregoing teachings in making various modifications, other embodiments and alternative forms of the invention.

It is, therefore, to be understood that the invention is not limited to the particular (embodiments or specific features shown herein. To the contrary, the inventor claims the invention in all of its various forms, including all alternatives, modifications, equivalents and alternative embodiments that fall within the legitimate and valid scope of the appended claims, appropriately interpreted under the Doctrine Of Equivalents.

INDUSTRIAL APPLICABILITY

The present invention may be used by any person, organization or governmental agency required to provide means for persons to wash their hands, surgical instruments, utensils and/or other objects at a location that is remote from a traditional civil water supply and waste water disposal system.

It is anticipated that the present invention will be most beneficially used within field hospitals, field clinics and by military personnel. Such persons, and particularly field surgeons and field dentists, now have means for safely, quickly and effectively washing their hands with cold, warm and/or hot water. Warm water or other warmed fluid can now be easily and readily dispensed even within the coldest of environments. Comfort and safety of the user is dramatically increased over what was otherwise available.

Similarly, persons attending scout camps, hunting camps, fishing camps, survival camps, sports camps, and the like, may benefit from using this invention.

In essence, the present invention may be used by any doctor, dentist, hunter, camper, fisherman, construction worker, road crew, farmer, field hand, peace corps worker, or any other person and/or occupation that could benefit from using a simple, reliable, durable, rugged, compact, transportable, washable, efficient, and manually or electrically operated apparatus for washing hands and other items at remote locations.

The present invention is inexpensive and economical to manufacture, and is easily constructed and used.

Traditional and/or nontraditional manufacturing apparatus and procedures may be used to manufacture the present invention without requiring significant alteration thereto to accomplish the purposes taught herein.

Once manufactured, the present invention can be easily stored, transported and used in only a minimum amount of space. Consequently, the invention minimizes the packaging size and cargo space required to contain and ship the apparatus. This, in turn, reduces storage and transportation costs. The present invention is relatively light in weight and is generally unobtrusive.

The preferred embodiment of the present invention has a special benefit of incorporating therein mass produced and commercially available component parts that are easily obtained, purchased, repaired and/or replaced throughout the country and abroad. Furthermore, since such mass produced component parts can be used, the apparatus can be manufactured for a very competitive price and maintained serviceable for an indefinite period of time.

A wide variety of different attachments or accessories may also be provided with the present invention.

For example, differently sized and/or shaped sinks or sink inserts may be provided either as separate units or as interchangeable items or liners within a single package. If combined into a single package, the unnecessary sink liners of undesired sizes may simply be discarded. As a result, the need to otherwise stock multiple different sizes of the invention for a wide variety of needs can be eliminated. Furthermore, conservation and rationing of fluid supplies can be maintained by using a sink size that appropriately meets the needs of the user.

By way of example, and not by way of limitation on the present invention, other attachments or accessories may include: electrically or manually controlled and operated pumps; internal heaters; thermostats; mounting brackets that enable the apparatus to be secured to a wall, counter or vehicle; height adjustable legs; covers for the external portable reservoirs that camouflage and/or enhance the absorption rate of solar heat; waste fluid filtration systems; and manual or automatic drain plug mechanisms.

The present invention need not be very complex.

However, the complexity of the invention may be increased if additional features, such as electric pumps, water heaters, thermostat controls, indicator lights, etc., are used.

I claim:

1. A portable sink apparatus attachable to an external, portable reservoir capable of containing a supply of fluid, said apparatus comprising the combination of:

(a) a cabinet housing defining an enclosure;

(b) a sink attached to or formed integrally with said cabinet housing;

(c) a fluid reservoir housing attached to or formed integrally with said cabinet housing, said fluid reservoir housing defining a fluid reservoir enclosure;

(d) a faucet attached or secured to said cabinet housing, said faucet operatively and movably communicating with said fluid reservoir enclosure;

(e) means for passing the fluid from the portable reservoir containing the supply of fluid into said fluid reservoir enclosure and out of said faucet into said sink;

(f) means for heating the fluid contained within said fluid reservoir enclosure; and (g) means for regulating said means for heating the fluid to generally control a temperature of the fluid contained within said fluid reservoir enclosure; said means for regulating said means for heating the fluid comprising a fluid level control switch operatively secured to said cabinet housing or to said fluid reservoir housing to measure a predetermined fluid level within said fluid reservoir enclosure.

2. The portable sink apparatus of claim 1, wherein said fluid level control switch is a float switch.

3. The portable sink apparatus of claim 1, wherein at least a portion of said fluid level control switch is placed within an upper one-half portion of said fluid reservoir enclosure.

4. The portable sink apparatus of claim 3, wherein said means for heating the fluid within said fluid reservoir enclosure is not activated until said faucet is raised from a non-extended position adjacent to said sink to an extended position and a volume of the fluid within the fluid reservoir enclosure is sufficiently large to activate said fluid level control switch.

5. A portable sink apparatus attachable to an external, portable reservoir capable of containing a supply of fluid, said apparatus comprising the combination of:

(a) a cabinet housing defining an enclosure;

(b) a sink attached to or formed integrally with said cabinet housing;

(c) a fluid reservoir housing attached to or formed integrally with said cabinet housing, said fluid reservoir housing defining a fluid reservoir enclosure;

(d) a faucet attached or secured to said cabinet housing, said faucet operatively and movably communicating with said fluid reservoir enclosure;

(e) means for passing the fluid from the portable reservoir containing the supply of fluid into said fluid reservoir enclosure and out of said faucet into said sink; and (f) a cover capable of being placed over the portable reservoir for containing the supply of fluid to enhance a solar heat absorption rate of the fluid contained therein.

* * * * *